US006626768B2

(12) United States Patent
Roelke

(10) Patent No.: US 6,626,768 B2
(45) Date of Patent: Sep. 30, 2003

(54) PUTTER GRIP

(76) Inventor: Harold Roelke, 13050 Gremoor Dr., Elm Grove, WI (US) 53122

( * ) Notice: Subject to any disclaimer, the term of this patent is extended or adjusted under 35 U.S.C. 154(b) by 0 days.

(21) Appl. No.: 09/730,307

(22) Filed: Dec. 5, 2000

(65) Prior Publication Data

US 2002/0077191 A1 Jun. 20, 2002

Related U.S. Application Data

(60) Provisional application No. 60/169,443, filed on Dec. 7, 1999.

(51) Int. Cl.[7] ..... A63B 53/14; A63B 53/16

(52) U.S. Cl. ..... 473/296; 473/297; 473/300

(58) Field of Search ..... 473/300, 301, 473/302, 303, 297, 315, 201, 203, 204

(56) References Cited

U.S. PATENT DOCUMENTS 3,252,706 A * 5/1966 Rosasco ..... 473/201
3,606,326 A * 9/1971 Sparks
4,022,470 A * 5/1977 Vidal ..... 473/301
4,272,077 A * 6/1981 Spivey ..... 473/300
4,327,916 A * 5/1982 Shiratori ..... 473/238
4,746,120 A * 5/1988 Mockovak ..... 473/201
4,826,168 A * 5/1989 McGuire et al. ..... 473/295
4,878,667 A * 11/1989 Tosti
4,979,743 A * 12/1990 Sears ..... 473/204
4,988,102 A * 1/1991 Reisner ..... 473/297
5,169,152 A * 12/1992 Marquardt
5,322,290 A * 6/1994 Minami
5,547,189 A * 8/1996 Billings
5,575,473 A * 11/1996 Turner
5,595,544 A 1/1997 Roelke
5,749,792 A * 5/1998 Engfer
5,766,088 A * 6/1998 Severtsen
5,779,559 A * 7/1998 Eberle
5,813,920 A * 9/1998 Rife

* cited by examiner

*Primary Examiner*—Stephen Blau
(74) *Attorney, Agent, or Firm*—Boyle Fredrickson Newholm Stein & Gratz S.C.

(57) ABSTRACT

A putter grip includes an overly-wide elongated cylindrical body extending from an upper end of the grip to a lower end. The grip is of at least generally uniform diameter along its entire length so as to form a step between its lower end and the shaft. The step is configured to receive a golfer's index and middle fingers on opposite sides of the shaft when engaging the grip.

13 Claims, 1 Drawing Sheet

PUTTER GRIP

CROSS-REFERENCE TO A RELATED APPLICATION

This application claims priority under 35 U.S.C. §119(e) to U.S. Provisional Patent Application No. 60/169,443, filed Dec. 7, 1999, the entirety of which is incorporated by reference herein.

BACKGROUND OF THE INVENTION

1. Field of the Invention

The invention relates to golf putter grips, and more particularly, to putter grips designed to inhibit a putter from twisting or turning during the putting stroke or to otherwise improve the ability of a golfer to grip the putter.

2. Discussion of the Related Art

One of the most important, if not the most important, part of any golfer's game is the ability to make putts accurately and with consistency. Indeed, when one considers that putting strokes typically account for one-half or more of a golfer's strokes, the age old expression "drive for show, putt for dough" becomes quite apt. It is therefore of little surprise that golfers and golf equipment manufacturers have devoted a significant amount of time and resources to produce putters which aid golfers in consistently striking the ball on the intended line and with the intended hardness. Most such designs deal with the composition and/or configuration of the putter head. Accordingly, oversized putter heads, specially shaped putter heads, putter heads with arrows and crosses, and putter heads made of brass and other materials designed to improve the "feel" of the putting stroke have all been proposed.

A few attempts have also been made to improve the putting stroke through improved shaft or grip design. Most notably, the so-called "long shaft" putter, having an unusually long shaft, has gained increased acceptance in recent years as a mechanism for improving putting accuracy.

One problem experienced by many golfers, and particularly high-handicappers, is the inability to hit the ball squarely. Even if a golfer having this problem manages to properly initially align the face of the putter with the ball, he or she has a tendency to twist or turn the club face either in or out during the putting stroke, causing the ball to veer away from its intended line after it is struck. This problem is especially evident in so-called mid-range puts in the range of 3–10 feet in which many golfers have a tendency to rush their putt and to look up before they should so that they can follow the path of the ball towards the hole. Mechanism designed to help golfers align the putter with the ball and/or to improve the feel of the putting stroke do little, if anything, to alleviate this problem.

Another problem in previous putter grips is that, given a shaft of a particular, standard length, the "grip height", i.e., the distance from the ground to the top of the grip, is fixed. This is an unattractive feature for tall golfers and those who like to grip at a higher point. For example, some golfers prefer to grip the putter at a higher point and to bend less. The effective lengths standard grips cannot be adjusted to provide different grip height.

OBJECTS AND SUMMARY OF THE INVENTION

It is therefore a primary object of the invention to provide an improved putter grip which enhances a golfer's ability to complete a putting stroke without twisting or turning the club face and which therefore facilitates driving the ball along the intended line of travel.

Another object of the invention is to provide a putter grip in accordance with the first object and which is ergonomically designed to maximize comfort to the golfer.

Still another object of the invention is to provide a putter grip that permits elevating the position of the grip on the shaft.

Yet, another object of the invention is to provide a putter, the grip of which has one or more of the advantages discussed above.

In accordance with a first aspect of the invention, at least some of these objects are achieved by providing an overly wide putter grip having little or no taper so as to form a step between the bottom of the grip and the shaft. The step is suitable for receiving the user's index and middle fingers of his or her forward hand on opposite sides of the shaft, thereby enhancing the ability of the golfer to swing the putter without twisting or turning the putter. The body further includes a tubular hollow portion extending upwardly from the bottom surface and configured to receive the shaft of a putter. The increased volume of the overly-wide grip fills the user's hands more than the traditional, narrower grip, adding enhanced feel and controllability.

In accordance with another aspect of the invention, the body is an elongated wide body having a generally cylindrical shape. The cylindrical body may have an elongated portion cut away or omitted to define an elongated flat wall. Preferably, this flat wall is generally aligned and parallel with the striking face of the putter so as to engage the forward hand and wrist of a golfer as he or she is striking the ball.

In accordance with still another aspect of the invention, the grip may be provided with optional spacers. The spacers are arranged vertically between the top of a putter shaft and the grip to set the amount that the grip slides over the shaft. The grip height of the putter can be adjusted by varying the number and/or thickness of the spacers.

In accordance with still yet another aspect of the invention, a putter is provided comprising a head, a shaft, and a grip. The head has a heel, a toe, and a striking face. The shaft has a lower end attached to the head between the heel and the toe thereof and has an upper end located above the lower end. The grip includes an elongated body of an oversized and at least generally constant diameter. The body is preferably cylindrical so as to have a longitudinal axis defining a hollow tubular portion within the body, which is mounted over the upper end of the shaft. The body has an upper end, a lower end, and the generally cylindrical surface. A step is formed between the lower end of the grip and the shaft. The step is suitable for receiving the golfer's index and middle fingers of his or her trailing hand during the stroke. A portion of the cylindrical body may be removed or omitted to produce a flat surface that further stabilizes the putter during the stroke.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

1. Resume

Pursuant to a preferred embodiment of the invention, a putter grip is provided which has a generally cylindrical body extending from a lower end to an upper end. The body is overly wide compared to conventional putter grips, and has little or no taper so as to form a step between the lower end of the grip and the shaft that. The step is suitable for receiving a user's index and middle fingers on opposite sides of the shaft to help ensure that the golf club will not twist or turn during a putting stroke and thus enhance the ability of the golfer to strike the ball squarely and to drive it along the intended line of travel. The cylindrical body may have a portion cut away so as to produce an elongated flat surface extending from the lower end of the grip to the upper end. The flat surface may be configured to further stabilize the club during the putting stroke. Optional spacers can be inserted between an upper end of the shaft and a ceiling of the bore of the grip to set a spacing between the upper end of the shaft and the ceiling bore.

2. Construction and Operation of a First Preferred Embodiment

Figure 1:
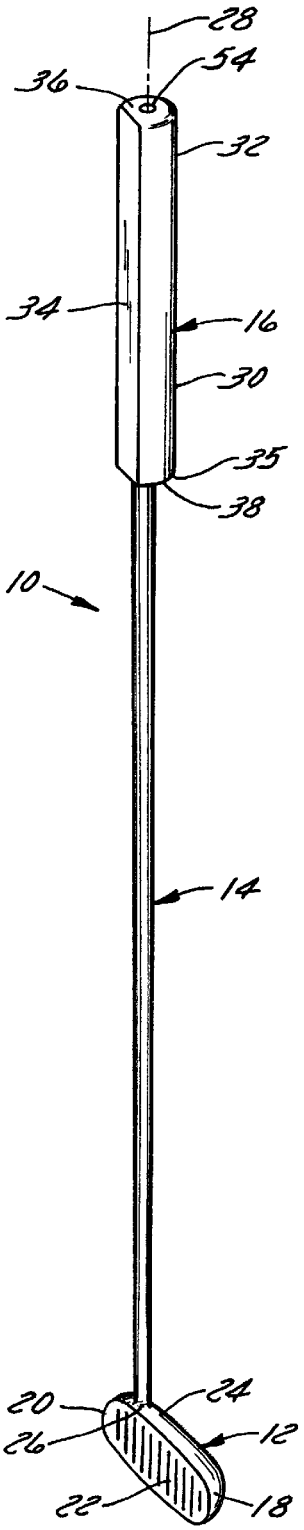
FIG. 1 is a perspective view of a putter incorporating a grip constructed in accordance with a first preferred embodiment of the present invention.
Figure 3:
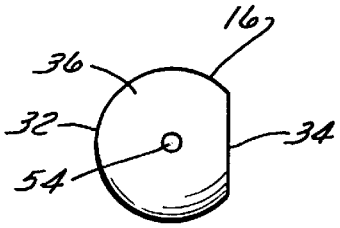
FIG. 3 is a top plan view of the grip of FIG. 1.
Figure 2:
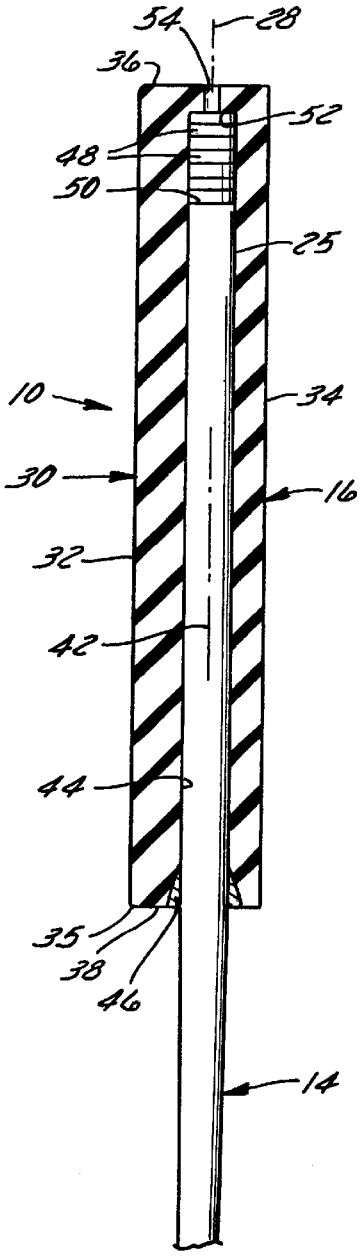
FIG. 2 is a sectional side elevation view of the grip of FIG. 1.

Referring now to FIGS. 1–3, a putter 10 is illustrated which is conventional in construction except for incorporating a grip constructed in accordance with a preferred embodiment of the invention. The putter 10 thus includes a head 12, a shaft 14, and a grip 16.

The head 12 may be any commercially available putter head formed from aluminum, brass, or any other material commonly used in putter heads. As is conventional, the head includes a front toe 18, a rear heel 20, a flat striking face 22 designed to engage the ball, and a top surface 24.

The shaft 14 is also conventional and may be formed from a steel tube as illustrated or from graphite or any other material commonly used in shafts. The shaft 14 has an upper end 25 which is covered by the grip 16 and a lower end 26 which is attached to the top 24 of the head 12. The shaft 14 is generally cylindrical and, therefore, has a longitudinal axis 28.

A first preferred embodiment of the grip 16 includes an elongated tubular molded body 30 having a first wall 32 that is partially cylindrical in shape and a second wall 34 that is generally flat. The body may be molded from a single material such as natural rubber, silicon rubber, plastic, or any other material commonly used in putter grips. The body 30 has an upper end 36 which is fully or partially closed either by an end portion molded integrally with the remainder of the body or by a cap or plug capable of fitting onto or into the upper end of the shaft 14. The body 30 further includes a lower end 38 which is open so as to be capable of sliding over the shaft 14. Preferably, the top end 36 of the grip 16 has a hole 54 to permit air to escape as the grip 16 is mounted on the shaft 14. An axial bore 44 is created within the grip 16 and is aligned with a longitudinal axis 42 of the grip 16. The diameter of the bore closely matches the diameter of the shaft so that the grip 16 tightly surrounds the shaft 14 when the shaft is inserted into the grip 16.

The grip 16 is constructed such that the maximum diameter of the grip formed by walls 32 and 40 is approximately 1⅝ to 1¾ inches maximum, with 1 11/16 inches preferred. This overall larger grip decreases flexing of the user's wrists during use. The grip 16 also has little or no taper so that its minimum diameter is at least 1½". As a result, when the grip 16 is mounted onto the ⅜" diameter shaft 14, a step 35 of considerable width is formed between the lower end 38 of the grip and the shaft 14. The step typically will be on the order ¼" to ⅝".

When the grip 16 is made of a material with relevant low resilience and/or the shaft 14 has a substantial taper such that the inner perimeter of the grip 16 will not form a tight seal with the outer perimeter of the shaft 14, one or more tapered wedges 46 can be inserted in the gap between the grip 16 and the shaft 14. This gap typically will be on the order 1/16" to ⅛" thick. The wedge(s) may be made from rubber, a polymeric material, or the like. Alternatively, the gap may be filled with an adhesive resin or the like to secure the grip 16 to the shaft 14.

Optionally, one or more spacers 48 may be inserted between an upper end 50 of the upper end 25 of the shaft 14 and a ceiling 52 of the bore 44 in the grip 16. The optional spacer(s) determine(s) the amount of overlap of the grip 16 onto the shaft 14 by setting a spacing between the upper end 50 of the shaft 14 and the ceiling 52 of the bore 44. This permits the position of the grip 16 relative to the shaft 14 to be adjusted by varying the number and/or thickness of the spacers 48, hence varying the putter's grip height.

It is contemplated that the user will engage the flat wall 34 with the palm of his or her forward hand and will engage the step 35 with his or her two fingers of the trailing hand on opposite sides of the shaft. The flat wall 34 therefore is aligned generally parallel with the flat striking space 22. The user's trailing hand then will engage the grip 16 generally around the partially cylindrical wall 32. Thus, the embodiment shown in FIG. 1 is designed for a left-handed golfer. The grip 16 could just as easily be configured for a right-handed golfer by mounting the grip onto the shaft 14 rotatably offset 180 degrees from the illustrated embodiment. However, the flat portion could be anywhere (i.e., the user can put it on any side the user wants).

In use, when a golfer is preparing to put, he or she aligns the clubface 22 of the putter 10 with the ball in the conventional manner. Assuming the golfer is a left handed golfer, he or she then grasps the grip 16 with the left hand in the conventional manner and with the right hand in a manner which is for the most part conventional. However, rather than overlapping the index finger of the golfer's right hand over the left hand, the golfer engages the step 35 of the grip 16 with his or her two fingers of the left hand on opposite sides of the shaft. Additionally, the golfer's wrist of his or her right hand will engage the flat wall 34. Gripping the club 10 in this manner has been found to inhibit or prevent the golfer from twisting or turning the club face in or out during the putting stroke, thereby greatly enhancing the golfer's ability to drive the ball along its intended travel path. It is believed that the geometry of the grip 16 achieves this result much more efficiently than grooves, furrows, or other irregularities in the surface of grips designed to improve a golfers hold on the grip. Moreover, unlike grooves, etcetera, and except for providing a new point of engagement for one of the golfer's fingers, the golfer is free to grasp the grip 16 in any way he or she desires with comfort and without interference from the surface of the grip 16. Furthermore, engaging the flat wall 34 of the grip 16 with the golfer's wrist of his or her right hand keeps the backside of the right hand square to the target, further enhancing the golfers ability to drive the ball along its intended travel path.

While the grip 16 includes both the cylindrical wall 32 and the flat wall 34, it could also be completely cylindrical. In this modification, the golfer's grip would be conventional except that the index and middle fingers of his or her trailing hand would engage the step 35 on opposite sides of the shaft.

3. Construction and Operation of a Second Preferred Embodiment

Although the grip 16 discussed above is preferred because it can be formed in a single molding step, it may be desirable to provide a grip made of two components. A grip made of two components, although more difficult to manufacture and more expensive than a grip made in a single molding step, may be advantageous to some because molding a rubber as thick as is required by the first preferred embodiment may be difficult.

Figure 4:
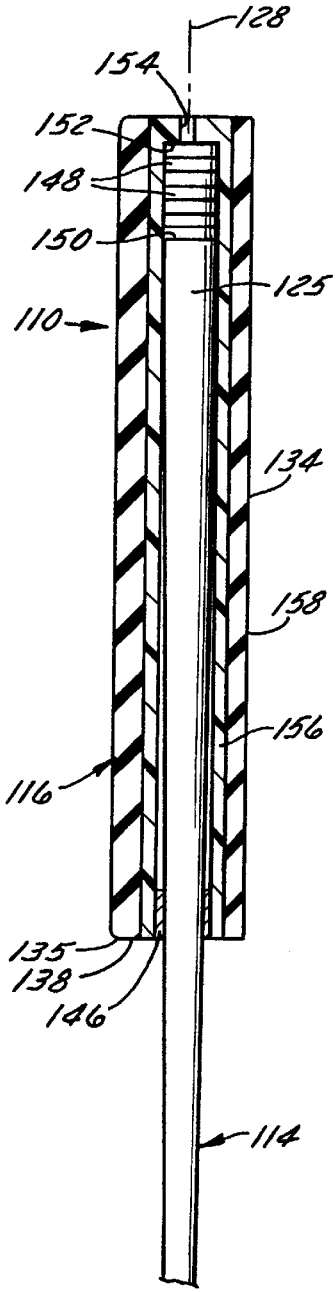
FIG. 4 is a sectional side elevation view of a grip constructed in accordance with a second preferred embodiment of the present invention.

Toward this end, referring to FIG. 4, a two-component grip 116 is illustrated for a putter 110 that is identical to the putter 10 of the first embodiment except that it incorporates two materials into the grip 116. Elements of the putter 110 of FIG. 4 corresponding to elements of the putter 10 of FIGS. 1–3 are, accordingly, designated by the same reference numerals, incremented by 100. The club 110 thus includes a head (not shown), a shaft 114, and a grip 116. A bore 144 in the grip 116 slips over the end of the shaft 114 to fix the grip in place. Also as in the first embodiment, a wedge 146 may be inserted in the gap between the bottom end of the grip 116 and the shaft 114 to help secure the grip 116 to the shaft 114. Spacers 148 may be inserted between the top 150 of the upper end 125 of the shaft 114 and the ceiling 152 of the bore 144 in the grip 116 to set the grip height of the grip 116.

The grip 116 differs from the grip 16 of the first embodiment only in that it is made of two components, a relatively rigid inner plastic sleeve 156 and a relatively pliant outer grip portion 158. The inner plastic sleeve 156 is preferably a high density polyethylene or a polypropylene. The two component grip 116 could be molded in a bi-material co-extrusion process. Alternatively, the two component grip 116 may be manufactured in separate steps, and the outer grip portion 158 may be slipped over and glued onto or otherwise affixed to the inner sleeve 156.

Of course, many modifications could be made to the invention as described an illustrated without departing from the spirit of the present invention. The scope of such changes will become apparent from the appended claims.

What is claimed is:

1. A putter grip comprising:

an elongated body of generally uniform diameter along an axial length thereof and having an upper end and a lower end, the body including a bore disposed within said lower end and extending upwardly so as to be configured to receive a shaft of a putter;

wherein said lower end of said body forms a step with the shaft, said step being dimensioned and configured to receive two fingers of a golfer on opposite sides of the shaft; and wherein said body has an outer periphery comprising a first wall that 1) is at least generally cylindrical in shape along at least substantially an entire periphery thereof and 2) has first and second opposed edges, and a second wall that 1) is at least generally planar in shape over at least substantially an entire area thereof and 2) has first and second opposed edges that adjoin said first and second opposed edges of said first wall, and is configured to be generally aligned and parallel to a striking face of the putter.

2. The grip of claim 1, wherein said grip is configured to be movable circumferentially about the shaft of the putter so as to reposition said generally flat second wall relative to the putter.

3. The grip of claim 1, wherein said step is configured to be between ¼ inch and ⅝ inch thick.

4. The grip of claim 3, wherein said step is configured to be ⅝ inch thick.

5. The grip of claim 1, wherein a maximum diameter of said grip is between 1⅝ inches and 1¾ inches.

6. The grip of claim 1, wherein the body comprises an inner sleeve and an outer grip portion of different materials.

7. A putter grip comprising:

an elongated body of generally uniform diameter along an axial length thereof and having an upper end and a lower end, the body including a bore disposed within said lower end and extending upwardly so as to be configured to receive a shaft of a putter;

wherein said lower end of said body forms a step with the shaft, said step being dimensioned and configured to receive two fingers of a golfer on opposite sides of the shaft; and wherein said body has an outer periphery comprising a first wall that 1) is at least generally cylindrical in shape along at least substantially an entire periphery thereof and 2) has first and second opposed edges, and a second wall that 1) is at least generally planar in shape over at least substantially an entire area thereof and 2) has first and second opposed edges that adjoin said first and second opposed edges of said first wall, wherein said grip is configured to be movable circumferentially about the shaft of the putter so as to reposition said generally flat second wall relative to the putter, and wherein said generally flat second wall is configured to be generally aligned and parallel with a striking face of the putter.

8. A putter grip comprising:

an elongated body of generally uniform diameter along an axial length thereof and having an upper end and a lower end, the body including a bore disposed within said lower end and extending upwardly so as to be configured to receive a shaft of a putter;

wherein said lower end of said body forms a step with the shaft, said step being dimensioned and configured to receive two fingers of a golfer on opposite sides of the shaft; and wherein said body has an outer periphery comprising a first wall that 1) is at least generally cylindrical in shape along at least substantially an entire periphery thereof and 2) has first and second opposed edges, and a second wall that 1) is at least generally planar in shape over at least substantially an entire area thereof and 2) has first and second opposed edges that adjoin said first and second opposed edges of said first wall, wherein the maximum diameter of said grip is about $1\frac{11}{16}$ inches.

9. A putter grip comprising:

an elongated body of generally uniform diameter along an axial length thereof and having an upper end and a lower end, the body including a bore disposed within said lower end and extending upwardly so as to be configured to receive a shaft of a putter;

wherein said lower end of said body forms a step with the shaft, said step being dimensioned and configured to receive two fingers of a golfer on opposite sides of the shaft; and wherein said body has an outer periphery comprising a first wall that 1) is at least generally cylindrical in shape along at least substantially an entire periphery thereof and 2) has first and second opposed edges, and a second wall that 1) is at least generally planar in shape over at least substantially an entire area thereof and 2) has first and second opposed edges that adjoin said first and second opposed edges of said first wall, and further comprising a wedge that is configured and dimensioned to be inserted between an inner perimeter of said grip and an outer perimeter of the shaft at a bottom of said grip.

10. A putter grip comprising:

an elongated body of generally uniform diameter along an entire axial length thereof, having a minimum outer diameter of at least about 1½ inches, and including (a) an upper end and a lower end;

(b) a bore disposed within said lower end and extending upwardly so as to be configured to receive a putter shaft; and (c) an outer periphery comprising 1) a first wall that a) is at least generally cylindrical in shape along at least substantially an entire periphery thereof and b) has first and second opposed edges, and 2) a second wall that a) is at least generally planar in shape over at least substantially an entire area thereof and b) has first and second opposed edges that adjoin said first and second opposed edges of said first wall, wherein said lower end of said body is configured to form a step with the shaft, said step being configured to receive two fingers of a golfer on opposite sides of the shaft, and wherein said generally flat second wall is configured to be generally aligned and parallel with a striking face of the putter.

11. The grip of claim 10, wherein said step is configured to be between ¼ inch and ⅝ inch thick.

12. The grip of claim 10, wherein a maximum diameter of said grip is between 1⅝ inches and 1¾ inches.

13. A putter grip comprising:

an elongated body of generally uniform diameter along an entire axial length thereof, having a minimum diameter of at least about 1½ inches, and including (a) an upper end and a lower end;

(b) a bore disposed within said lower end and extending upwardly so as to be configured to receive a putter shaft;

(c) a first wall that is partially cylindrical in shape; and (d) a second wall that is at least generally flat, wherein said lower end of said body is configured to form a step with the shaft, said step being configured to receive two fingers of a golfer on opposite sides of the shaft, (e) a spacer arrangement configured and dimensioned to fit into the body and to span a gap between an upper end of the bore in the body and an upper end of the shaft; and (f) a wedge that is configured to be inserted between an inner perimeter of said grip and an outer perimeter of the shaft.

* * * * *